US006827186B1

(12) United States Patent
Hsie

(10) Patent No.: US 6,827,186 B1
(45) Date of Patent: Dec. 7, 2004

(54) PULL ROD CONTROL MECHANISM OF LUGGAGE

(75) Inventor: Hung-Ching Hsie, Chang Hua Hsien (TW)

(73) Assignee: Hando Industrial Co., Ltd., Yuan Lin Township (TW)

( * ) Notice: Subject to any disclaimer, the term of this patent is extended or adjusted under 35 U.S.C. 154(b) by 0 days.

(21) Appl. No.: 10/464,909

(22) Filed: Jun. 20, 2003

(51) Int. Cl.[7] ..... A45C 13/26
(52) U.S. Cl. ..... 190/115; 16/113.1
(58) Field of Search ..... 16/113.1; 190/115, 190/18 A

(56) References Cited

U.S. PATENT DOCUMENTS 5,911,263 A * 6/1999 Wu ..... 190/115
6,338,586 B1 * 1/2002 Kuo ..... 190/115
6,357,080 B1 * 3/2002 Tsai ..... 16/113.1
6,378,674 B1 * 4/2002 Lee ..... 190/115
6,405,407 B1 * 6/2002 Chen ..... 16/113.1
6,470,529 B1 * 10/2002 Chang ..... 16/113.1

* cited by examiner

*Primary Examiner*—Tri. M. Mai
(74) *Attorney, Agent, or Firm*—Harrison & Egbert

(57) ABSTRACT

An expandable pull rod of luggage includes a top tube, a bottom tube, and a plurality of intermediate tubes which are arranged telescopically between the top tube and the bottom tube in conjunction with a plurality of control devices. Each device has a base, a locating member, and an actuating body. The locating member is formed of a first spring, a first locating block, a second spring, and a second locating block. The first spring and the first locating block are at work such that the first locating block is located in a first locating hole of the intermediate tube at the time when the pull rod is expanded. When the pull rod is contracted, the second spring and the second locating block are at work such that the second locating block is located in a second locating hole of the intermediate tube.

1 Claim, 9 Drawing Sheets

PULL ROD CONTROL MECHANISM OF LUGGAGE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a luggage pull rod, and more particularly to a telescopic control mechanism of the luggage pull rod.

BACKGROUND OF THE INVENTION

The conventional luggage pull rod structure is of a telescopic construction and is formed of a top tube, a bottom tube, and a plurality of telescopic intermediate tubes disposed between the top tube and the bottom tube. The telescopic control mechanism of the conventional luggage pull rod is attained by a plurality of control devices, each being disposed in the bottom end of each intermediate tube. When the conventional luggage pull rod is in the state of retraction or extraction, the intermediate tubes are located by the control devices.

The control devices of the conventional luggage pull rod structure are complicated in construction and can not be assembled economically, thereby resulting in an increase in production cost of the luggage. In light of the structural complication of the control devices, the conventional luggage pull rod structure is prone to failure after frequent use.

BRIEF SUMMARY OF THE INVENTION

The primary objective of the present invention is to provide a luggage pull rod structure with a control mechanism which is simple in construction, durable, and cost-effective.

In keeping with the principle of the present invention, the foregoing objective of the present invention is attained by a luggage pull rod structure comprising a top tube, a bottom tube, a plurality of telescopic intermediate tubes, and a plurality of control devices, each being disposed in a bottom end of each intermediate tube. The control devices comprise a base, a locating member, and an actuating body. The base is fastened to the bottom end of the intermediate tube. The locating member is formed of a first housing, a first spring, a first locating block, a second spring, and a second locating block. The housing is provided with two guide projections. The first spring and the first locating block are disposed in one end of the housing such that the first locating block is urged by the first spring. The second spring and the second locating block are disposed at the outside of other end of the first housing such that the second spring is fitted over one end of the second locating block, and that the other end of the second locating block is urged by the first spring. The locating member is disposed in a bottom end of the base. The actuating body is provided with two guide slots corresponding with the two guide projections of the housing. The actuating body is disposed in a top end of the base such that the two guide projections of the housing of the locating member are slidably received in the two guide slots of the actuating body.

When the luggage pull rod is in the state of extraction, the locating of the top tube, the intermediate tubes, and the bottom tube is attained by the first locating blocks of the control devices. On the other hand, when the luggage pull rod is in the state of retraction, the locating of the top tube, the intermediate tubes, and the bottom tube is achieved by the second locating blocks of the control devices.

The features and the advantages of the present invention will be more readily understood upon a thoughtful deliberation of the following detailed description of a preferred embodiment of the present invention with reference to the accompanying drawings.

BRIEF DESCRIPTION OF THE SEVERAL VIEWS OF THE DRAWINGS

FIG. 3 shows a longitudinal sectional view of the control device of the present invention in.

DETAILED DESCRIPTION OF THE INVENTION

Figure 1:
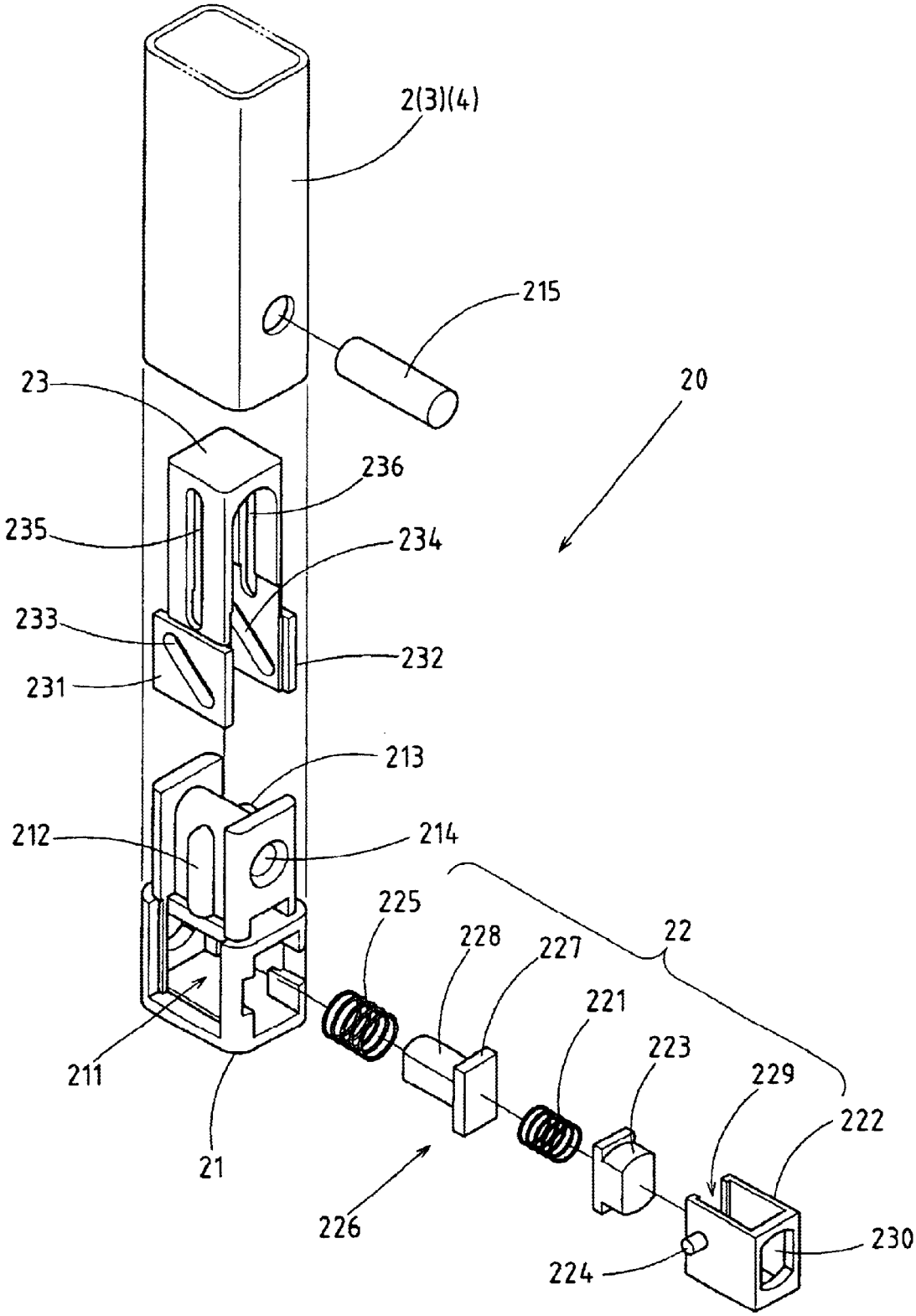
FIG. 1 shows an exploded perspective view of the control device of the present invention.
Figure 2:
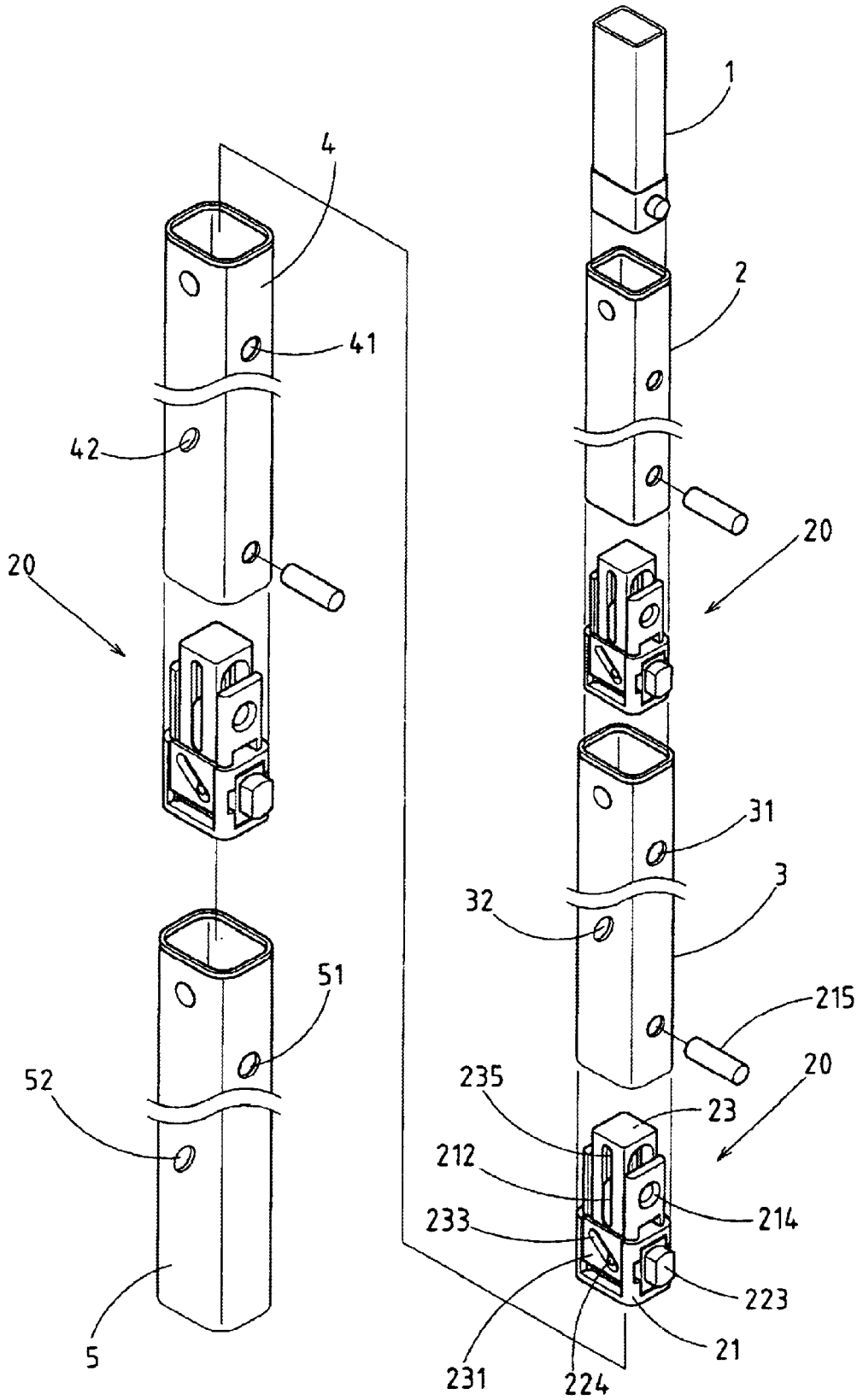
FIG. 2 shows an exploded perspective view of the luggage pull rod structure of the present invention.
Figure 3:
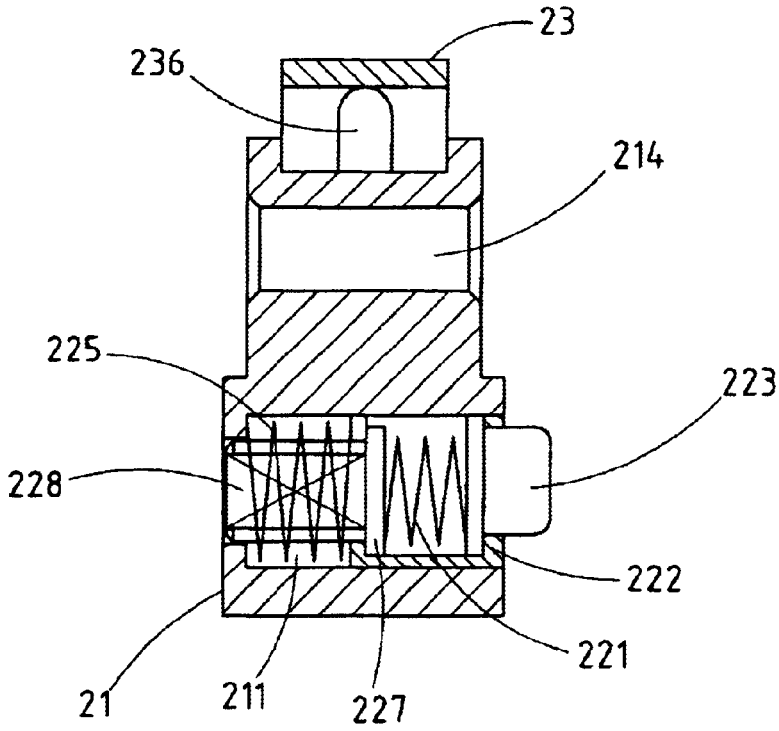

As shown in FIGS. 1–4, an expandable pull rod structure embodied in the present invention comprises a top tube 1, a bottom tube 5, a first intermediate tube 2, a second intermediate tube 3, a third intermediate tube 4, and three control devices 20. The three intermediate tubes 2, 3, and 4 are telescopically arranged between the top tube 1 and the bottom tube 5 in conjunction with the control devices 20. The control devices 20 are identical in construction to one another and are subject matters of the present invention. The expandable pull rod of the present invention is expanded by pulling the top tube 1 and is contracted by pressing the top tube 1 to bring about the telescopic effect of the intermediate tubes 2, 3, and 4.

The control devices 20 are mounted respectively in the bottom end of the intermediate tubes 2, 3, and 4. The control devices 20 comprise a base 21, a locating member 22, and an actuating body 23.

The base 21 is provided in an upper portion with two guide rails 212, 213, and a fastening hole 214 by which the base 21 is fastened to a bottom end of the intermediate tubes 2, 3, and 4. The base 21 is provided in a lower portion with a cell 211 in which the locating member 22 is disposed.

The locating member 22 is formed of a first housing 222, a first locating block 223, a first spring 221, a second spring 225, and a second locating block 226. The first housing 222 is provided with two guide projections 224 and two through holes 229 and 230. The first locating block 223 is movably disposed in the housing 222, while the first spring 221 is disposed in the housing 222 such that one end of the first spring 221 urges one end of the first locating block 223. The housing 222 is located in the cell 211 of the base 21. The second locating block 226 is located in the cell 211 of the base 21 such that a stop plate 227 of one end of the second locating block 226 is urged by the other end of the first spring 221. The second spring 225 is located in the cell 211 of the base 21 such that the second spring 225 is fitted over a projection 228 of the second locating block 226, with one end of the second spring 225 urging the stop plate 227 of the second locating block 226 and with the other end of the second spring 225 urging the wall of a through hole of the cell 211 of the base 21. The first spring 221 is smaller in spring force than the second spring 225.

The actuating body 23 is provided with two guide slots 235 and 236, and two guide plates 231 and 232. The guide plate 231 is provided with an inclined guide slot 233, while the guide plate 232 is provided with an inclined guide slot 234. The actuating body 23 is joined with the upper portion of the base 21 such that the two guide slots 235 and 236 of the actuating body 23 are fitted with the two guide rails of the actuating body 23 are fitted with the two guide rails 212 and 213 of the base 21, and that the two inclined guide slots 233 and 234 are fitted with the two guide projections 224 of the first housing 222.

Figure 5:
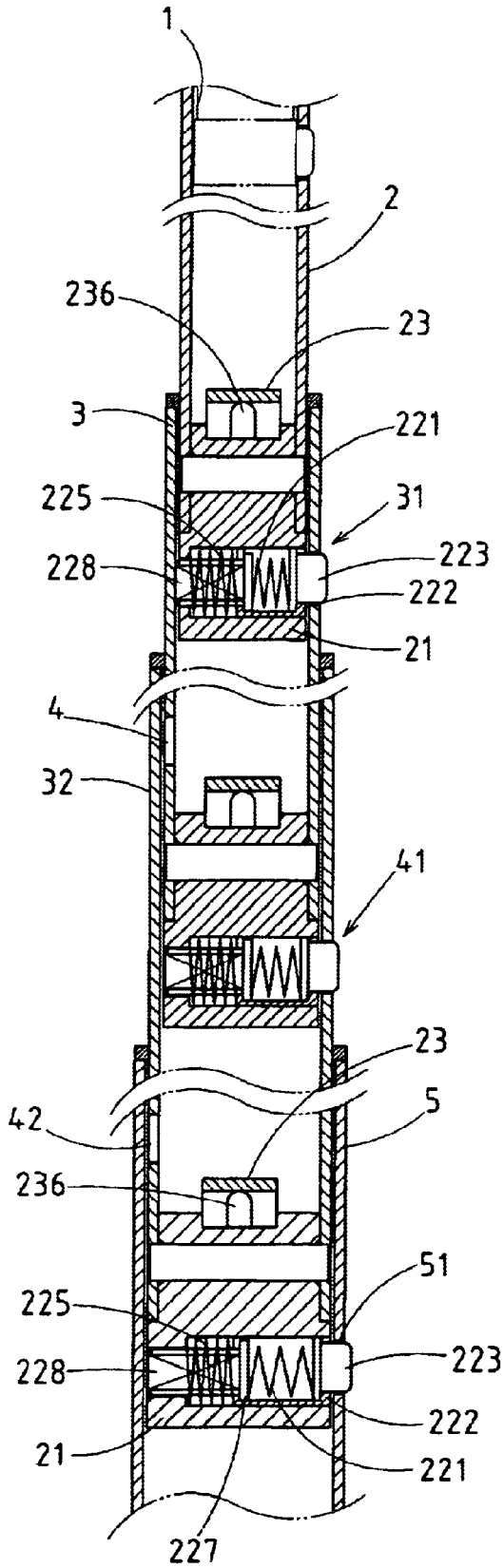
FIG. 5 shows a longitudinal sectional view of the luggage pull rod structure of the present invention in the state of full extraction.
Figure 6:
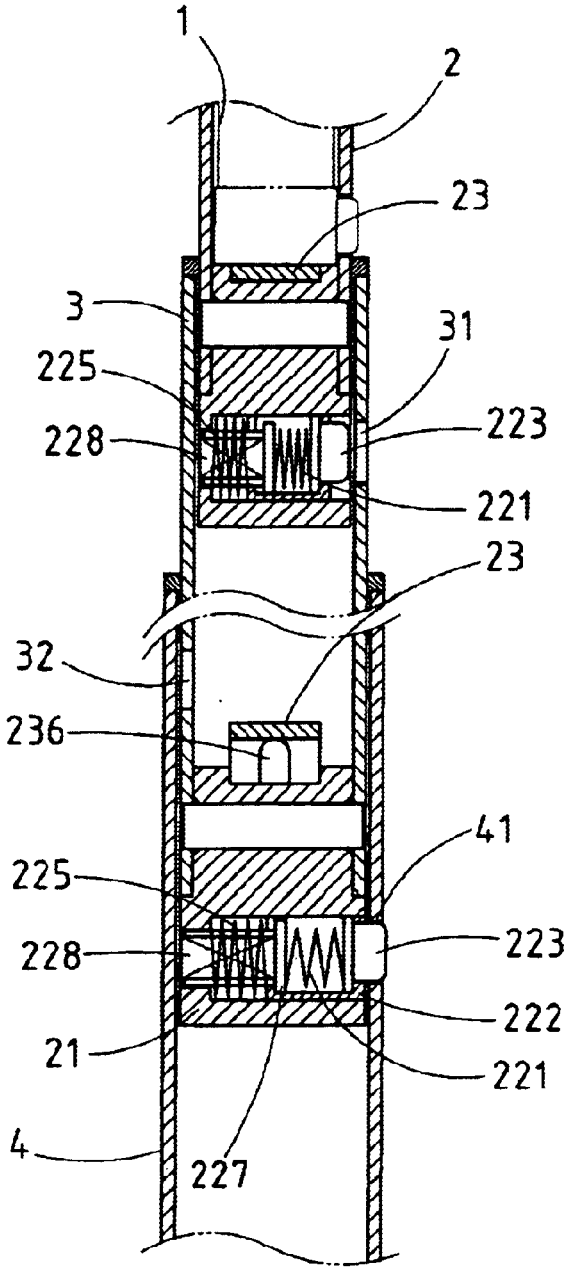
FIG. 6 is a longitudinal sectional view to show that the top tube is slid into a first intermediate tube of the present invention.

As shown in FIG. 5, the expandable pull rod is fully expanded such that the first locating blocks 223 of the control devices 20 are respectively located in the first locating holes 31, 41 of the intermediate tubes 3, 4, and the locating hole 51 of the bottom tube 5.

Figure 4:
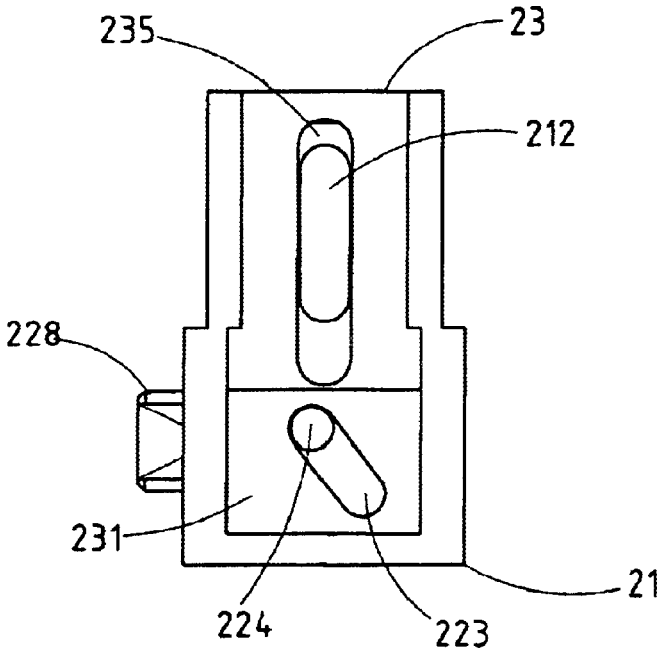
FIG. 4 shows a schematic view of the actuating body of the control device of the present invention at work.
Figure 7:
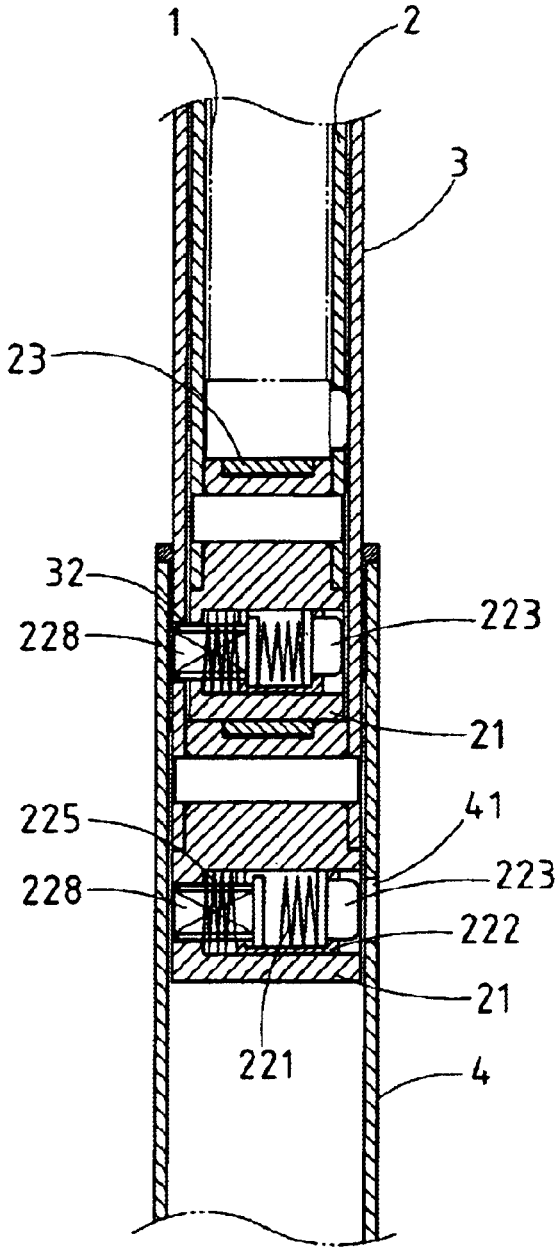
FIG. 7 is a longitudinal sectional view to show that the first intermediate tube is slid into a second intermediate tube of the present invention.
Figure 8:
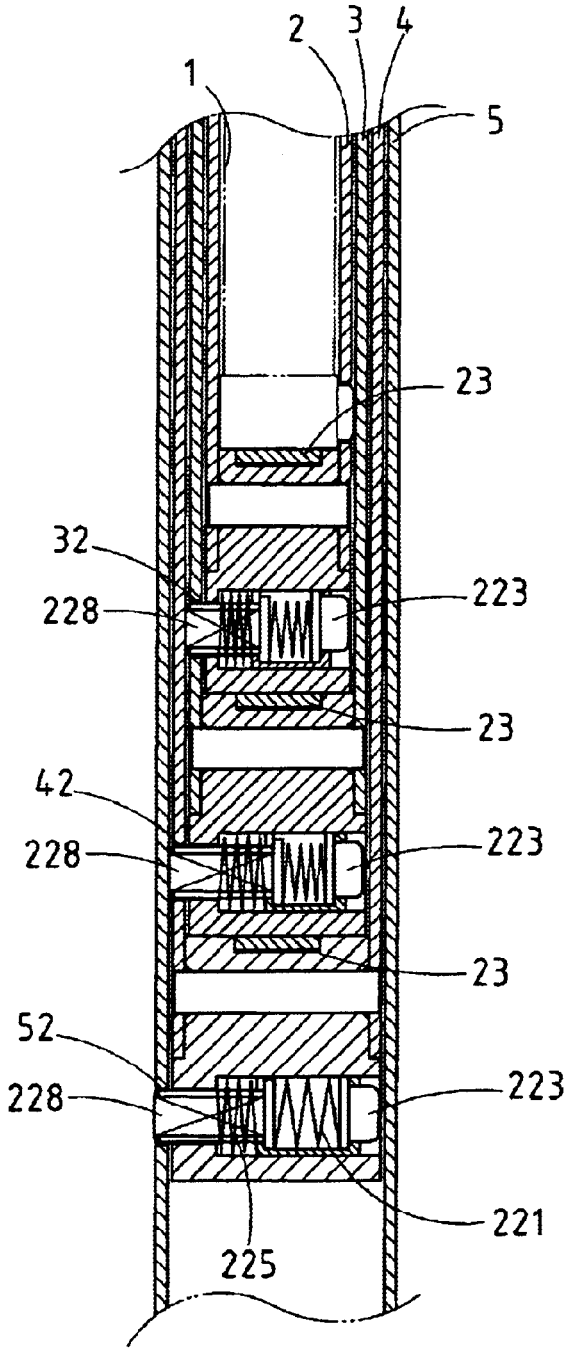
FIG. 8 shows a longitudinal sectional view of the luggage pull rod structure of the present invention in the state of full retraction.
Figure 9:
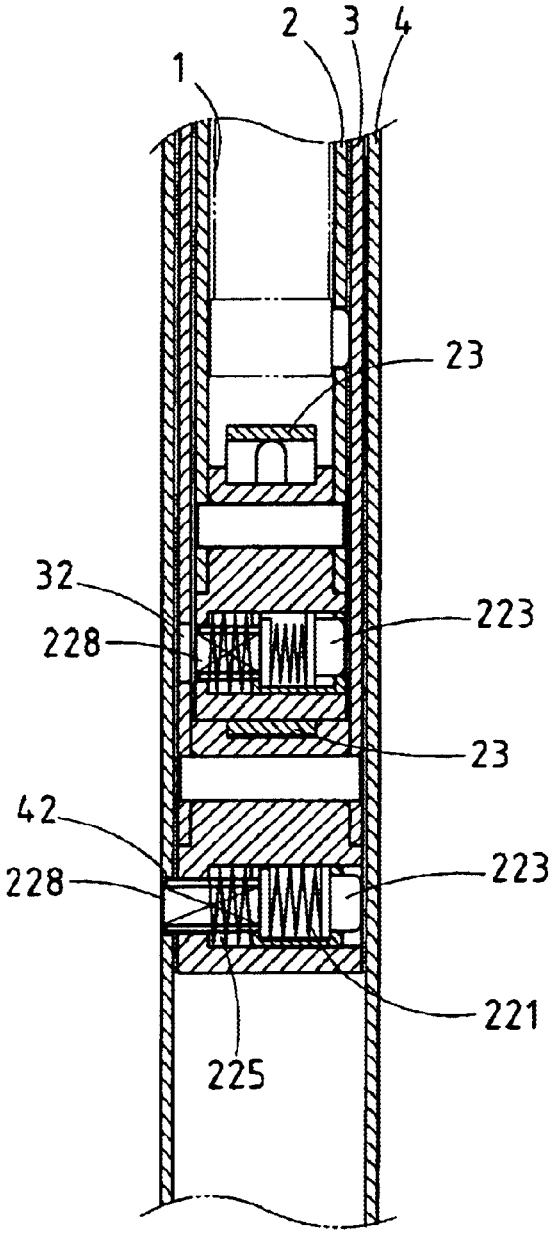
FIG. 9 is a longitudinal sectional view to show that the top tube is pulled to separate from the first intermediate tube of the present invention.
Figure 10:
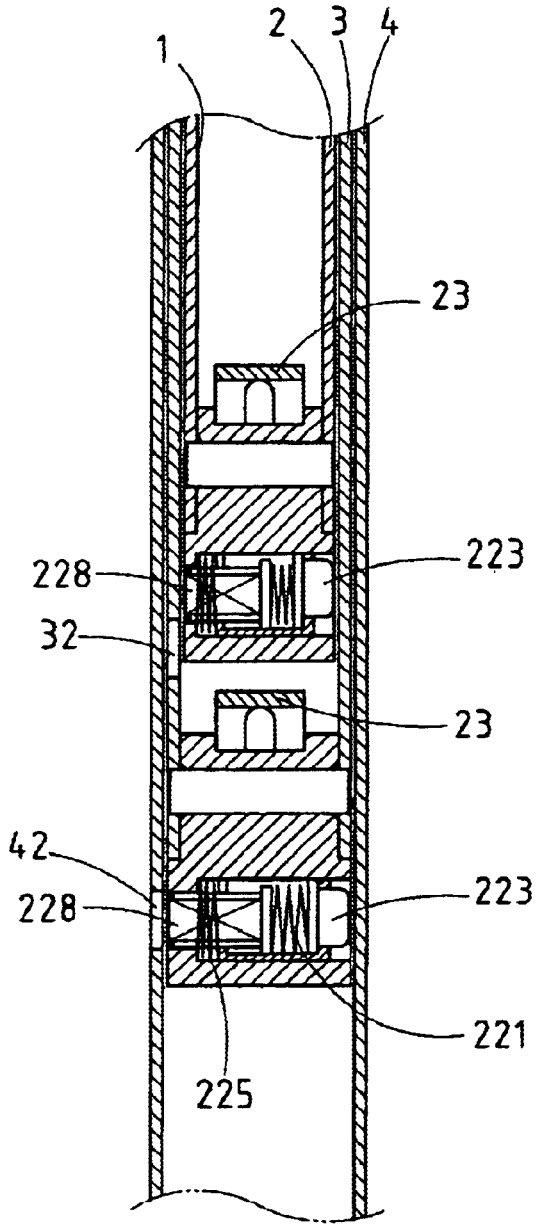
FIG. 10 is a longitudinal sectional view to show that the first intermediate tube is pulled to separate from the second intermediate tube of the present invention.

As shown in FIG. 4, when the top tube 1 is pressed to cause the expandable pull rod to contract, the first housing 222 of the control device 20 is actuated by the actuating body 23 to move in the cell 211 of the base 21 such that the guide projections 224 of the first housing 222 move along the inclined guide slots 233 and 234 of the actuating body 23. As a result, the second spring 225 is compressed. In the meantime, the second locating block 226 is caused to displace such that the projection 228 of the second locating block 226 is forced out to locate in the second locating holes 32, 42 of the intermediate tubes 3 and 4, as well as the second locating hole 52 of the bottom tube 5, as illustrated in FIGS. 7, 8, and 9.

When the top tube 1 is pulled to relieve the first intermediate tube 2 of the pressure, the first housing 222 is no longer restrained by the actuating body 23. As a result, the second locating block 226 is caused by the spring force of the second spring 225 to move out of the second locating hole of the intermediate tube. In the meantime, the displacement of the second locating block 226 causes the first locating block 223 to displace to locate in the first locating hole of the intermediate tube. It must be noted here that the second spring 225 is greater in spring force than the first spring 221.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. An expandable pull rod of luggage comprising:

a top tube;

a bottom tube; and a plurality of intermediate tubes arranged telescopically between the top tube and the bottom tube in conjunction with a plurality of control devices, each control device being fastened to a bottom end of one of the intermediate tubes for locating the intermediate tube when the tubes are expanded or contracted;

wherein each of said control devices comprises:

a base comprised of, in an upper portion, a fastening hole for fastening said base to a bottom end of the intermediate tube, and, in the upper portion, two guide rails, and in a lower portion thereof, a cell;

an actuating body comprised of two guide slots and two inclined guide slots whereby said actuating body is movably joined with the upper portion of said base such that said two guide slots are fitted with said two guide rails of said base; and a locating member disposed in said cell of said base and comprised of a first housing; a first locating body movably located in said first housing; a first spring located in said first housing such that one end of said first spring urges said first locating block; a second locating block disposed in said cell of said base such that one end of said second locating block is urged by another end of said first spring; and a second spring fitted over a projection of the other end of said second locating block whereby said first housing is comprised of two guide projections which are slidably located in said two inclined guide slots of said actuating body, thereby enabling said first housing to be actuated to displace to allow said first locating block to be located in a first locating hole of the intermediate tube at the time when the expandable pull rod is expanded, said first housing being actuated by said actuating body so as to displace in said cell of said base when the top tube is pressed, thereby causing said projection of said second locating block to displace to locate in a second locating hole of the intermediate tube.

* * * * *